US006422487B1

(12) United States Patent
Imoehl

(10) Patent No.: US 6,422,487 B1
(45) Date of Patent: Jul. 23, 2002

(54) DEPOSIT RESISTANT MATERIAL FOR A FUEL INJECTION SEAT AND METHOD OF MANUFACTURING

(75) Inventor: William James Imoehl, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/538,729

(22) Filed: Mar. 30, 2000

(51) Int. Cl.[7] ..... F02M 61/20

(52) U.S. Cl. ..... 239/533.9; 239/533.2; 239/584; 239/DIG. 19

(58) Field of Search ..... 239/DIG. 19, 596, 239/533.3, 533.9, 533.2, 533.12, 533.14, 583, 584, 585.1, 585.5; 251/332; 29/890.122

(56) References Cited

U.S. PATENT DOCUMENTS

| | | | | | |
|---|---|---|---|---|---|
| 4,390,130 | A | | 6/1983 | Linssen et al. | 239/585 |
| 4,421,278 | A | | 12/1983 | Kienzle et al. | 239/533 |
| 4,531,679 | A | | 7/1985 | Pagdin | 239/585 |
| 4,981,266 | A | | 1/1991 | Aichele et al. | 239/463 |
| 5,186,393 | A | * | 2/1993 | Yie | 239/583 |
| 5,330,100 | A | | 7/1994 | Malinowski | 239/102.2 |
| RE35,079 | E | * | 11/1995 | Sverdin | 239/533.9 X |
| 5,649,358 | A | * | 7/1997 | Adachi et al. | 29/888.4 |
| 5,758,829 | A | * | 6/1998 | Itoh et al. | 239/533.2 |
| 5,979,801 | A | * | 11/1999 | Munezane et al. | 239/533.12 |
| 6,311,901 | B1 | | 11/2001 | Imoehl et al. | 239/533.2 |

* cited by examiner

*Primary Examiner*—Lesley D. Morris

(57) ABSTRACT

An injector seat assembly for a fuel injector is provided. The injector seat assembly includes an injector seat having a longitudinal seat channel and a longitudinal channel axis extending therethrough. The injector seat is constructed from a first material. An insert is fixedly inserted into the longitudinal seat channel. The insert has a longitudinal insert channel and a longitudinal insert channel axis extending along the longitudinal seat channel axis. The insert is constructed from a second material, different from the first material. A method of constructing the injector seat assembly is also provided.

20 Claims, 3 Drawing Sheets

DEPOSIT RESISTANT MATERIAL FOR A FUEL INJECTION SEAT AND METHOD OF MANUFACTURING

FIELD OF THE INVENTION

The present invention relates to a valve seat for a fuel injector which includes a deposit resistant material in areas on the valve seat where deposits detrimental to injector performance can form.

BACKGROUND OF THE INVENTION

Fuel injectors are used in internal combustion engines to provide a measured amount of fuel to each combustion chamber. The tips of the injectors protrude into the combustion chamber, and are exposed to a high temperature atmosphere containing fuel and air. Fuel in the presence of air at elevated temperatures reacts with metal in the injector, typically stainless steel, which is used to form the injector tip. The product of this reaction is a hard residue adhering to all surfaces wet with fuel and exposed to elevated temperatures and air. These surfaces include critical surfaces such as the inside of the fuel orifice all the way up to the sealing band of the seat, including the transition cone. The deposits on these surfaces restrict flow and distort the pattern and atomization of the injector fuel spray, resulting in higher emissions and reduced running stability of the engine.

Although combustion systems have been designed to reduce tip temperatures and to provide a cleansing air flow across the injector tip, making conditions for deposit less than optimal, deposits still form on the injector tip due to the reaction of the fuel with the stainless steel of the tip.

It would be beneficial to develop an injector surface exposed to fuel and air at elevated temperatures which is constructed from a material which retards or prevents the formation of deposits on the surface.

BRIEF SUMMARY OF THE INVENTION

Briefly, the present invention discloses a fuel injector having an inlet, an outlet, and a passageway providing a fuel flow conduit from the inlet to the outlet. The fuel injector comprises a needle and an injector seat assembly. The needle is positionable in the passageway between a first position occluding the passageway and a second position permitting fuel flow. The injector seat assembly includes an injector seat having a longitudinal seat channel and a longitudinal channel axis extending therethrough. The injector seat is constructed from a first material. An insert is fixedly inserted into the longitudinal seat channel. The insert has a longitudinal insert channel and a longitudinal insert channel axis extending along the longitudinal seat channel axis. The insert is constructed from a second material, different from the first material.

Additionally, the present invention discloses an injector seat assembly comprising an injector seat having a longitudinal seat channel and a longitudinal channel axis extending therethrough. The injector seat is constructed from a first material. An insert is fixedly inserted into the longitudinal seat channel. The insert has a longitudinal insert channel and a longitudinal insert channel axis extending along the longitudinal seat channel axis. The insert is constructed from a second material, different from the first material.

Further, the present invention discloses a method of manufacturing an injector seat assembly comprising providing a valve seat blank having a longitudinal seat channel extending therethrough; installing an insert into the longitudinal seat channel; and forming a longitudinal insert channel in the insert, the longitudinal insert channel being co-axial with the longitudinal seat channel.

BRIEF DESCRIPTION OF THE DRAWINGS

The accompanying drawings, which are incorporated herein and constitute part of this specification, illustrate a presently preferred embodiment of the invention, and, together with the general description given above and the detailed description given below, serve to explain the features of the invention. In the drawings.

DETAILED DESCRIPTION OF THE PREFERRED EMBODIMENT

Figure 1:
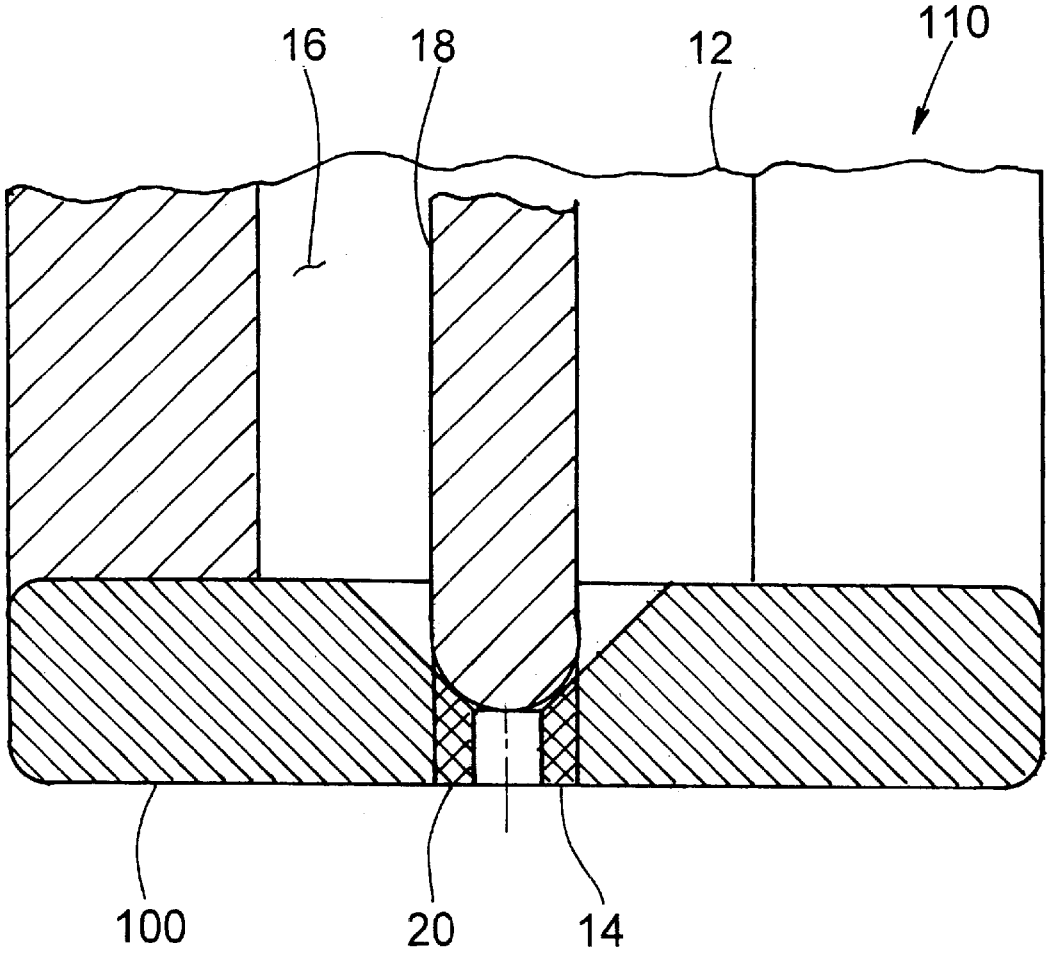
FIG. 1 is a side profile view, in section, of a downstream end of a fuel injector utilizing a valve seat assembly according to the present invention.

In the drawings, like numerals are used to indicate like elements throughout. As shown in FIG. 1, a fuel injector 110 has an inlet 12, an outlet 14, and a passageway 16 providing a fuel flow conduit from the inlet 12 to the outlet 14. The fuel injector 110 includes a needle 18 positionable in the passageway 16 between a first position occluding the passageway 16 and a second position permitting fuel flow past the needle 18 and past a valve seat assembly 100 for flow through the passageway 16.

Figure 2:
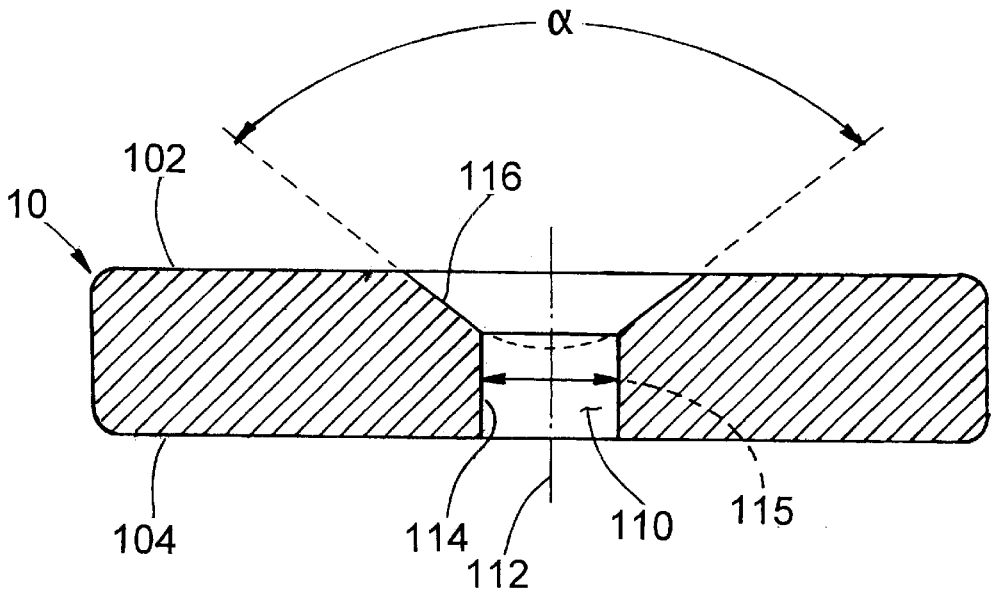
FIG. 2 is a side profile view, in section, of a valve seat blank according to a preferred embodiment of the present invention.
Figure 3:
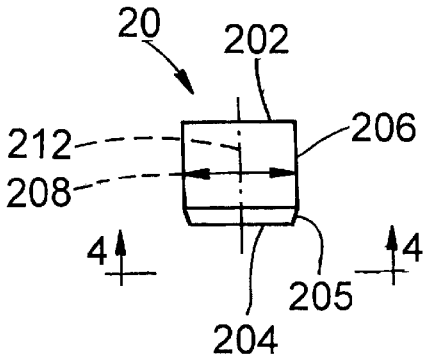
FIG. 3 is a side profile view, in section, of a valve seat insert according to the preferred embodiment of the present invention.
Figure 4:
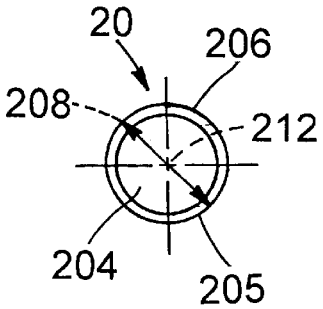
FIG. 4 is a top plan view of the valve seat insert taken along line 4—4 of FIG. 3.

A valve seat blank 10 for the valve seat assembly 100 is shown in FIG. 2. An insert 20 for insertion into the valve seat blank 10 is shown in FIGS. 3 and 4. The insert 20 is inserted into the valve seat blank 10 to form the valve seat assembly 100, shown in FIG. 5. The valve seat assembly 100 is inserted in the fuel injector 110 proximate to the tip (not shown).

Referring to FIG. 2, the valve seat blank 10 includes an upstream side 102 and a downstream side 104. As used herein, "upstream" is defined to mean a direction toward the top of the figure referenced and "downstream" is defined to mean the bottom of the figure referenced. Preferably, the valve seat blank 10 is constructed from stainless steel, although those skilled in the art will recognize that the valve seat blank 10 can be constructed from other materials as well. A longitudinal channel 110 extends therethrough, preferably along a longitudinal seat axis 112. The longitudinal channel 110 includes a channel wall 114, and a diameter 115. The channel wall 114 extends downstream from a location between the upstream side 102 and the downstream side 104 of the valve seat blank 10 to the downstream side 104 of the valve seat blank 10. Preferably, the channel wall 114 is generally parallel to the longitudinal seat axis 112.

A sealing cone 116 is located in the valve seat blank 10 between the upstream side 102 and the channel wall 114. The sealing cone 116 is generally centered around the longitudinal seat axis 112 and tapers generally downstream and inward toward the longitudinal seat axis 112. Preferably, the sealing cone 116 has a cone angle α of approximately 104 degrees relative to the longitudinal seat axis 112, although those skilled in the art will recognize that the cone angle α can be other sizes as well. The sealing cone 116 mates with a reciprocating valve needle (not shown) which seats in the sealing cone 116 in a closed position to seal the longitudinal seat channel 110 preventing pressurized fuel in the injector from flowing through the longitudinal seat channel 110.

Referring now to FIGS. 3 and 4, the insert 20 includes an upstream end 202 and a downstream end 204. Preferably, the downstream end 204 includes a beveled face 205 for reasons that will be explained. The insert 20 also includes an outer wall 206 which extends generally from the upstream end 202 to the beveled face 205 and has a diameter 208. The insert 20 also includes a longitudinal insert axis 212 extending therethrough. Preferably, the insert 20 is constructed from a ceramic material that retards or is resistant to the formation of deposits thereon.

Figure 5:
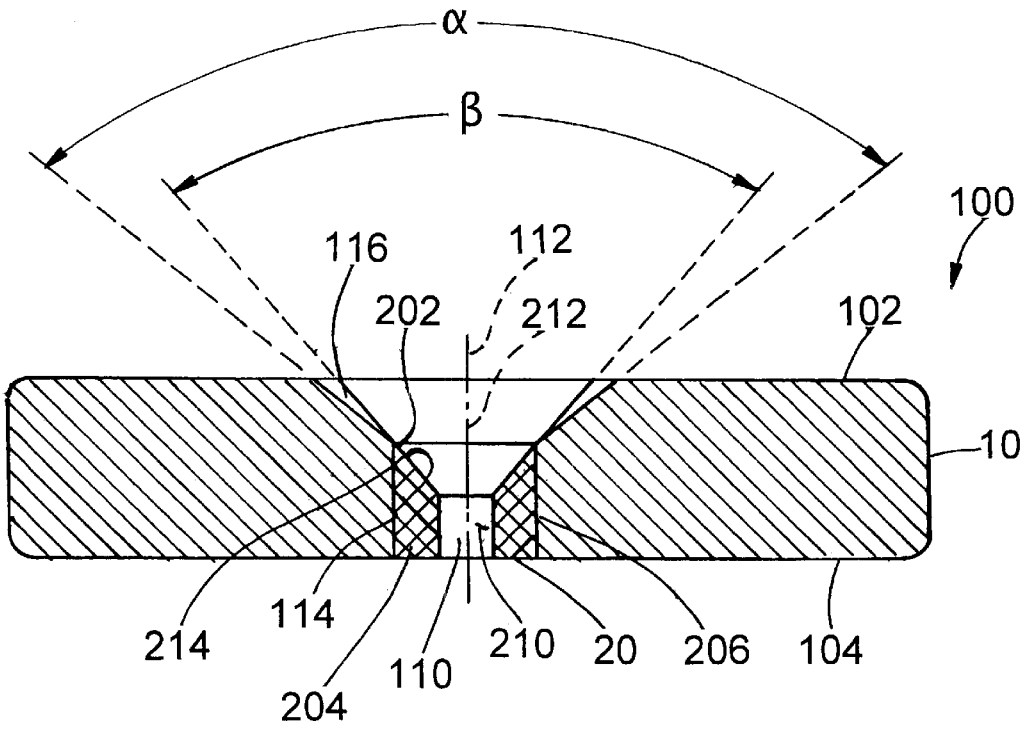
FIG. 5 is a side profile view, in section, of a machined valve seat assembly according to the preferred embodiment of the present invention.

To form the valve seat 100 shown in FIG. 5, the downstream end 204 of the insert 20 is inserted into the longitudinal seat channel 110 through the upstream end 102 of the valve seat insert 10 and the sealing cone 116. The beveled face 205 of the downstream end 204 engages the sealing cone 116 and guides the insert 20 into the longitudinal seat channel 110. The beveled face 205 helps to prevent the insert 20 from cocking at an angle during insertion. Preferably, the insert 20 is inserted into the longitudinal seat channel 116 such that the upstream end 202 of the insert 20 is flush with the interface between the downstream end of the sealing cone 116 and the upstream end of the longitudinal seat channel 110. Preferably, the insert 20 is sufficiently long so that the entire beveled face 205 extends beyond the downstream end 104 of the valve seat blank 10. Preferably, the diameter 208 of the insert 20 is larger than the diameter 115 of the longitudinal seat channel 116, forming an interference fit between the outer wall 206 of the insert 20 and the channel wall 114 of the valve seat blank 10. Those skilled in the art will recognize that, in order for the insert 20 to fit into the longitudinal seat channel 116, the valve seat blank 10 is preferably heated to temporarily expand the valve seat blank 10 and enlarge the longitudinal seat channel 116 sufficiently to enable the insert 20 to be inserted therein. The valve seat blank 10 is then cooled to reduce the longitudinal seat channel 116 and securely retain the insert 20 therein. Those skilled in the art will recognize that other methods of securing the insert 20 to the valve seat blank 10, such as tapering the longitudinal seat channel 116, welding the insert 20 to the valve seat blank 10, upsetting material from the valve seat blank 10 over the insert 20, or heat treating the valve seat blank 10 and insert 20, forming a molecular bond between the valve seat blank 10 and the insert 20.

Once the insert 20 is inserted into the longitudinal channel 116, the insert 20 is machined. A longitudinal insert channel 210, shown in FIG. 5, is machined along the longitudinal insert axis 212, which is preferably co-axial with the longitudinal seat axis 112. The downstream end 204 of the insert 20 which protrudes beyond the downstream end 104 of the valve seat blank 10 is machined smooth with the downstream end 104 of the valve seat blank 10, forming a sharp edge of the longitudinal insert channel 210 at the downstream end 204.

The upstream end 202 of the insert 20 is machined to form a transition cone 214 transition cone 214 extends from the upstream end 202 to the longitudinal insert channel 10 at an angle relative to the longitudinal insert axis 212. Preferably, the angle is approximately 85 degrees, although those skilled in the art will recognize that the angle can be more or less than 85 degrees. The transition cone 214 is preferably the same transition cone disclosed in U.S. Provisional Patent Application No. 60/131,251, filed Apr. 27, 1999, for which US utility application Ser. No. 09/559,748 was filed on Apr. 27, 2000, now U.S. Pat. No. 6,311,901 issued on Nov. 6, 2001 and assigned to the assignee of the present invention, the disclosure of which is incorporated by reference herein in its entirety.

Those skilled in the art will recognize that the steps of manufacturing the valve seat assembly 100 can be performed in other orders than those recited above, while providing the same end product.

The insert 20 is located in the valve seat assembly 100 in the longitudinal seat channel 116 where deposits tend to form as a result of combustion. The material from which the insert 20 is preferably constructed retards or prevents deposits from forming in the longitudinal seat channel 116, allowing the longitudinal seat channel 116 to remain its desired size and allowing a desired amount of fuel to flow through the longitudinal seat channel 116.

It will be appreciated by those skilled in the art that changes could be made to the embodiment described above without departing from the broad inventive concept thereof. It is understood, therefore, that this invention is not limited to the particular embodiments disclosed, but it is intended to cover modifications within the spirit and scope of the present invention as defined in the appended claims.

What is claimed is:

1. A fuel injector having an inlet, an outlet, and a passageway providing a fuel flow conduit from the inlet to the outlet, the fuel injector comprising:

a needle positionable in the passageway between a first position occluding the passageway and a second position permitting fuel flow; and an injector seat assembly including:

an injector seat having a longitudinal seat channel extending along a longitudinal channel axis, the longitudinal seat channel having at least a first portion and at least a second portion, the at least a first portion having a first surface oblique to the longitudinal axis, the injector seat being constructed from a first material; and an insert fixedly inserted into the longitudinal seat channel, the insert having a longitudinal insert channel and a longitudinal insert channel axis extending along the longitudinal seat channel axis, the insert having a second surface oblique to the longitudinal insert channel axis and contiguous the at least first portion of the channel so that fuel flowing through the fuel injector contacts the first and second surfaces, the insert being constructed from a second material different from the first material.

2. The injector according to claim 1, wherein the insert is fixedly inserted into the longitudinal seat channel with an interference fit.

3. The injector according to claim 1, wherein the second material comprises a ceramic.

4. A fuel injector having an inlet, an outlet, and a passageway providing a fuel flow conduit from the inlet to the outlet, the fuel injector comprising:

a needle positionable in the passageway between a first position occluding the passageway and a second position permitting fuel flow; and an injector seat assembly including:

an injector seat having a longitudinal seat channel extending along a longitudinal channel axis, the longitudinal seat channel having at least a first portion and at least a second portion, the at least a first portion oblique to the longitudinal axis, the injector seat being constructed from a first material; and an insert fixedly inserted into the longitudinal seat channel, the insert having a longitudinal insert channel and a longitudinal insert channel axis extending along the longitudinal seat channel axis, the insert having a surface oblique to the longitudinal insert channel axis and contiguous to the at least a first portion of the channel, the insert being constructed from a second material different from the first material, wherein the valve seat includes a valve cone angle of 104 degrees.

5. A fuel injector having an inlet, an outlet, and a passageway providing a fuel flow conduit from the inlet to the outlet, the fuel injector comprising:

a needle positionable in the passageway between a first position occluding the passageway and a second position permitting fuel flow; and an injector seat assembly including:

an injector seat having a longitudinal seat channel and a longitudinal channel axis extending therethrough, the injector seat being constructed from a first material, the injector seat includes a sealing cone angle of about 104 degrees; and an insert fixedly inserted into the longitudinal seat channel, the insert having a longitudinal insert channel and a longitudinal insert channel axis extending along the longitudinal seat channel axis, the insert being constructed from a second material, different from the first material, the insert includes a transition cone having a transition cone angle smaller than the sealing cone angle.

6. The injector according to claim 5, wherein the transition cone angle is about 85 degrees.

7. The injector according to claim 1, wherein the longitudinal seat channel is generally parallel to the longitudinal channel axis.

8. The injector according to claim 1, wherein the second material retards deposit growth relative to the first material.

9. An injector seat assembly comprising:

an injector seat having a longitudinal seat channel extending along a longitudinal channel axis, the longitudinal seat channel having at least a first portion and at least a second portion, the at least a first portion having a first surface oblique to the longitudinal axis, the injector seat being constructed from a first material; and an insert fixedly inserted into the longitudinal seat channel, the insert having a longitudinal insert channel and a longitudinal insert channel axis extending along the longitudinal seat channel axis, the insert having a second surface oblique to the longitudinal insert channel axis and contiguous to the at least first portion of the channel so that fuel flowing through the seat assembly contacts the first and second surfaces, the insert being constructed from a second material different from the first material.

10. The injector seat assembly according to claim 9, wherein the insert is fixedly inserted into the longitudinal seat channel with an interference fit.

11. The injector seat assembly according to claim 9, wherein the second material comprises a ceramic.

12. An injector seat assembly comprising:

an injector seat having a longitudinal seat channel extending along a longitudinal channel axis, the longitudinal seat channel having at least a first portion and at least a second portion, the at least a first portion oblique to the longitudinal axis, the injector seat being constructed from a first material; and an insert fixedly inserted into the longitudinal seat channel, the insert having a longitudinal insert channel and a longitudinal insert channel axis extending along the longitudinal seat channel axis, the insert having a surface oblique to the longitudinal insert channel axis and contiguous to the at least first portion of the channel, the insert being constructed from a second material different from the first material, wherein the valve seat includes a valve cone angle of 104 degrees.

13. The injector seat assembly according to claim 12, wherein the insert includes a transition cone angle smaller than the sealing cone angle.

14. The injector seat assembly according to claim 13, wherein the transition cone has a cone angle of about 85 degrees.

15. The injector seat assembly according to claim 9, wherein the longitudinal seat channel is generally parallel to the longitudinal channel axis.

16. The injector seat assembly according to claim 9, wherein the second material retards deposit growth relative to the first material.

17. A method of manufacturing an injector seat assembly, comprising:

providing a valve seat blank having a longitudinal seat channel extending along a longitudinal seat axis, the longitudinal seat channel having at least a first portion and at least a second portion, the at least a first portion having a first surface oblique to the longitudinal seat axis;

installing an insert into the longitudinal seat channel;

forming a longitudinal insert channel in the insert; and forming a second surface on the insert, the second surface being oblique to the longitudinal insert channel axis and contiguous to the at least first portion of the channel such that fuel operatively flowing through the assembled seat assembly contacts the first and second surfaces, the longitudinal insert channel being co-axial with the longitudinal seat channel.

18. The method according to claim 17, wherein the insert comprises a ceramic.

19. The method according to claim 17, further comprising, prior to installing the insert into the longitudinal seat channel, heating the valve seat blank and expanding the valve seat channel.

20. The method according to claim 17, wherein forming the longitudinal insert channel includes machining the insert.

* * * * *